US008316781B1

(12) United States Patent
Majors

(10) Patent No.: US 8,316,781 B1
(45) Date of Patent: Nov. 27, 2012

(54) METHOD AND APPARATUS FOR MODULAR FURNITURE

(76) Inventor: Stanley Barton Majors, Hattiesburg, MS (US)

( * ) Notice: Subject to any disclaimer, the term of this patent is extended or adjusted under 35 U.S.C. 154(b) by 98 days.

(21) Appl. No.: 12/931,510

(22) Filed: Feb. 3, 2011

Related U.S. Application Data

(60) Provisional application No. 61/338,448, filed on Feb. 19, 2010.

(51) Int. Cl.
*A47B 13/00* (2006.01)

(52) U.S. Cl. ..... 108/158.12; 108/64; 108/180

(58) Field of Classification Search ..... 108/180, 108/186, 192, 193, 157.18, 157.17, 159, 108/64, 50.01, 26
See application file for complete search history.

(56) References Cited

U.S. PATENT DOCUMENTS

| | | | | |
|---|---|---|---|---|
| 1,520,518 | A | 12/1924 | Thomason | |
| 1,870,978 | A | 8/1932 | Wolfe | |
| 3,241,885 | A * | 3/1966 | Deaton | 108/64 |
| 3,415,007 | A | 12/1968 | Howe | |
| 3,669,033 | A | 6/1972 | Murcia | |
| 3,966,337 | A | 6/1976 | Crawford | |
| 4,039,133 | A * | 8/1977 | Streicher | 108/158.11 |
| 4,163,537 | A * | 8/1979 | Mourgue | 108/158.12 |
| 4,212,130 | A | 7/1980 | Walker | |
| 4,216,729 | A * | 8/1980 | Schrader | 108/159 |
| 4,223,945 | A | 9/1980 | Nikitits | |
| 4,270,302 | A | 6/1981 | Dandia | |
| 4,915,034 | A | 4/1990 | Grabe et al. | |
| 5,226,864 | A | 7/1993 | Showers | |
| D370,045 | S | 5/1996 | Derbecker | |
| 5,715,760 | A * | 2/1998 | Frascaroli et al. | 108/50.02 |
| 5,775,046 | A * | 7/1998 | Fanger et al. | 108/158.12 |
| 5,813,737 | A * | 9/1998 | Stone | 108/155 |
| 5,899,423 | A * | 5/1999 | Albertini | 108/50.11 |
| 5,988,077 | A * | 11/1999 | Balderi | 108/64 |
| 6,220,180 | B1 * | 4/2001 | Janowitz | 108/50.01 |
| 6,283,042 | B1 * | 9/2001 | Wargo et al. | 108/26 |
| 6,341,566 | B1 * | 1/2002 | Hwang | 108/180 |
| 6,382,109 | B1 | 5/2002 | Novikoff | |
| 8,191,488 | B2 * | 6/2012 | Sacco | 108/158.12 |
| 2004/0198141 | A1 | 10/2004 | Buhrman et al. | |

* cited by examiner

*Primary Examiner* — Jose V Chen
(74) *Attorney, Agent, or Firm* — George L Williamson

(57) ABSTRACT

Method and apparatus discloses a modular furniture construction having interlocking connections which are formed by upright standing legs having vertical grooves therein for receiving interlocking connecting members therein disposed on the ends of cross members. The cross members can be arranged in many different arrays so that a table top support or legs and/or other configurations, e.g., forts and houses, can be constructed. The cross members are designed so that a table top or tray can be placed thereon for receiving various items therein and/or a cup can be placed thereon for receiving containers holding liquid therein.

17 Claims, 8 Drawing Sheets

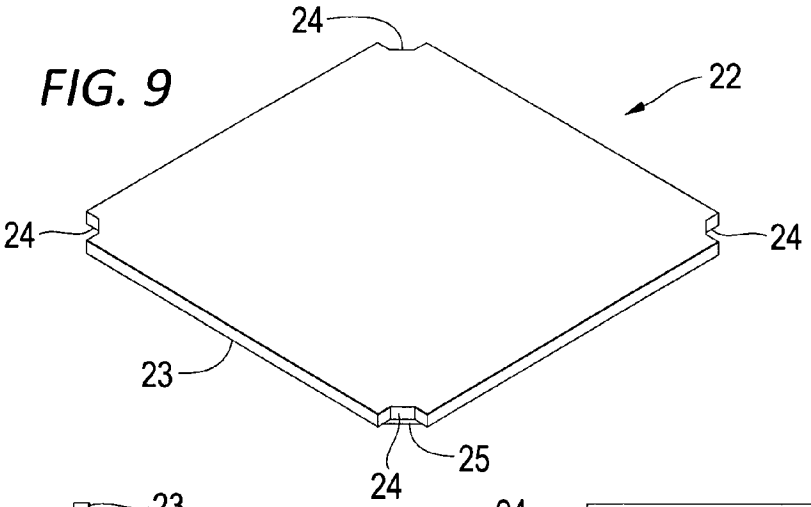
FIG. 9
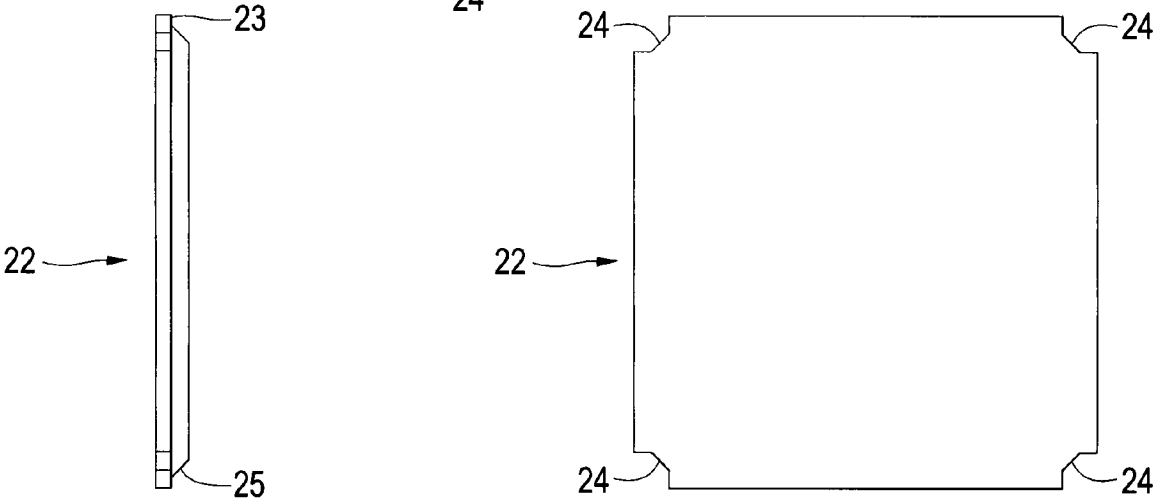
FIG. 10
FIG. 11

METHOD AND APPARATUS FOR MODULAR FURNITURE

RELATED APPLICATIONS

This application claims benefit of U.S. Provisional Application Ser. No. 61/338,448 filed on Feb. 19, 2010.

BACKGROUND OF THE INVENTION

1. Field of the Invention

The present invention relates generally to furniture and, more particularly, is concerned with a modular construction of furniture such as tables.

2. Description of the Prior Art

Modular furniture has been described in the prior art, however, none of the prior art devices disclose the unique features of the present invention.

In U.S. Pat. No. 4,270,302 dated Jun. 2, 1981, Dandia disclosed a construction toy. In U.S. Pat. No. 3,966,337 dated Jun. 29, 1976, Crawford disclosed a modular post and beam joint. In U.S. Patent Application Publication 2004/0198141 dated Oct. 7, 2004, Buhrman, et al., disclosed a children's panel and connector building set. In U.S. Pat. No. 6,382,109 dated May 7, 2002, Novikoff disclosed a self-leveling modular table and method of forming a level modular table. In U.S. Patent No. D 370,045 dated May 21, 1996, Derbecker disclosed a combined modular children's activity and learning center. In U.S. Pat. No. 5,226,864 dated Jul. 13, 1993, Showers disclosed a playground maze apparatus. In U.S. Pat. No. 4,915,034 dated Apr. 10, 1990, Grabe, et al., disclosed a table system. In U.S. Pat. No. 4,233,945 dated Sep. 23, 1980, Nikitits disclosed a collapsible table and seat assembly. In U.S. Pat. No. 4,212,130 dated Jul. 15, 1980, Walker disclosed a playhouse with elements based on two modular units. In U.S. Pat. No. 3,669,033 dated Jun. 13, 1972, Murcia disclosed modular shelving and furniture. In U.S. Pat. No. 3,415,007 dated Dec. 10, 1968, Howe disclosed a building set with basic construction elements. In U.S. Pat. No. 1,870,978 dated Aug. 9, 1932, Wolfe disclosed a toy building unit. In U.S. Pat. No. 1,520,518 dated Dec. 23, 1924, Thomason disclosed a coupling for tabletops.

While these modular furniture units may be suitable for the purposes for which they were designed, they would not be as suitable for the purposes of the present invention as hereinafter described.

SUMMARY OF THE PRESENT INVENTION

The present invention discloses a modular furniture construction having interlocking connections which are formed by upright standing legs having vertical grooves therein for receiving interlocking connecting members therein disposed on the ends of cross members. The cross members can be arranged in many different arrays so that a table top support or legs and/or other configurations, e.g., forts and houses having additional floors, can be constructed. The cross members are designed so that a table top or tray can be placed thereon for receiving various items therein and/or a cup can be placed thereon for receiving containers holding liquid therein.

An object of the present invention is to provide a table constructed of modular components which can be arrayed in many different configurations. A further object of the present invention is to provide a table that can be easily assembled and disassembled for storage without the need of any fasteners or tools. A further object of the present invention is to provide a table having accessories thereon wherein items can be stored such as pencils, crayons, and/or cups containing liquid therein.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which:

FIG. 9 is a perspective view of a top of the table of the present invention.

FIG. 10 is a side view of a top of the table of the present invention.

FIG. 11 is a plan view of a top of the table of the present invention.

LIST OF REFERENCE NUMERALS

Figure 1:
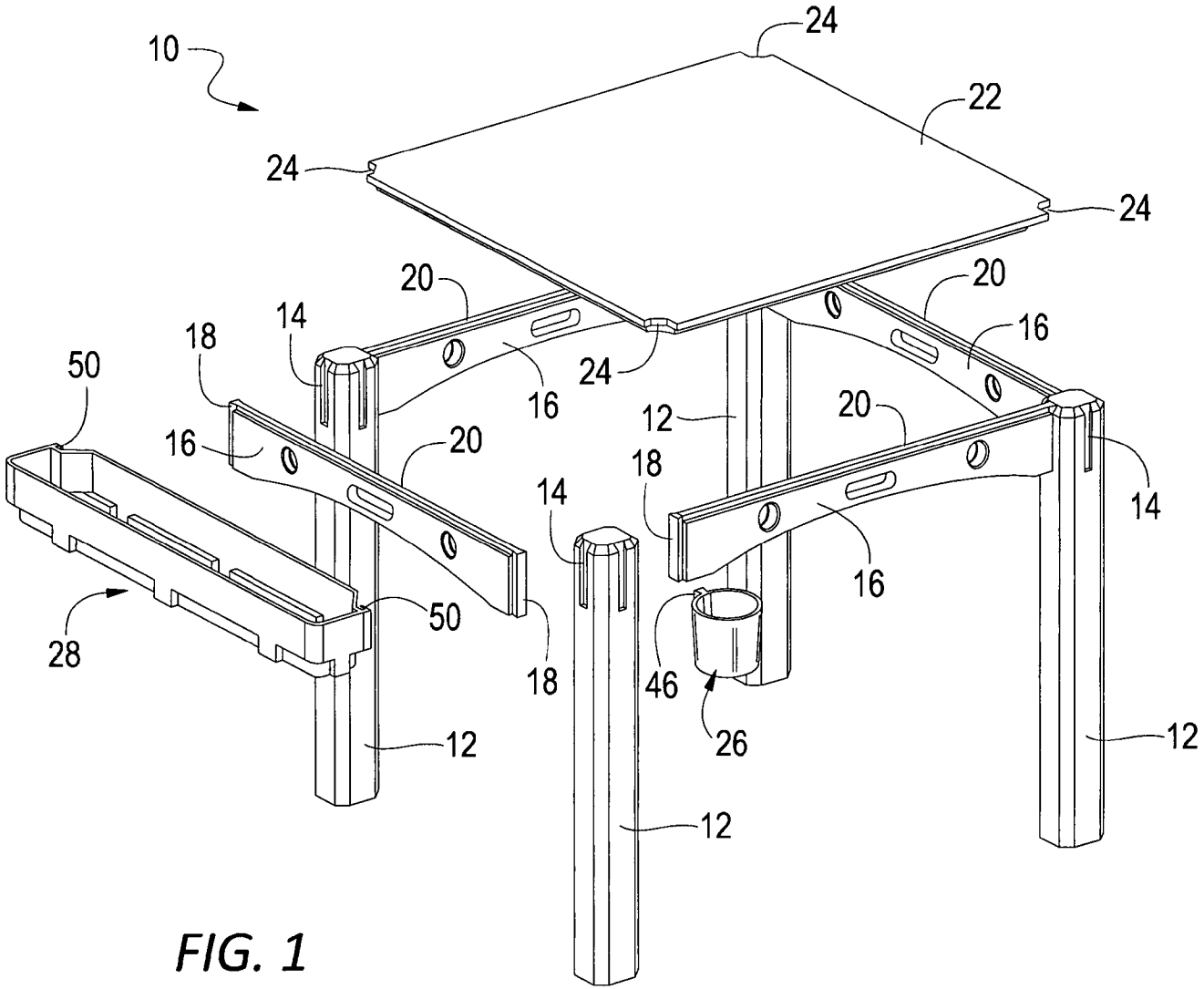
FIG. 1 is a perspective view of the present invention.
Figure 2:
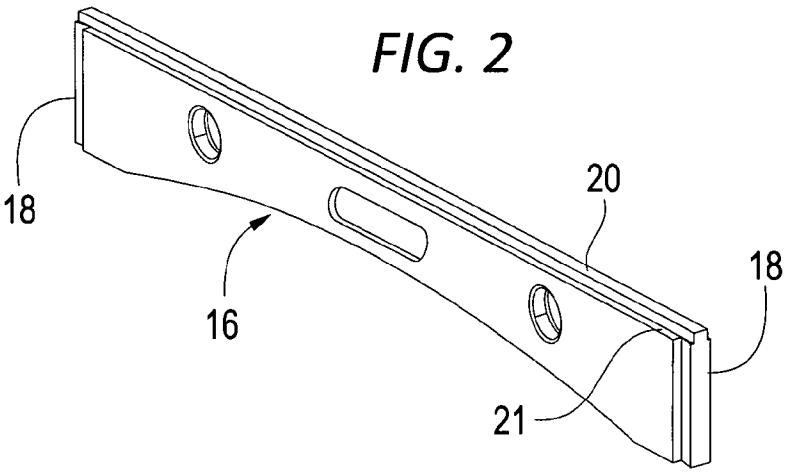
FIG. 2 is a perspective view of a cross member of the present invention.
Figure 3:
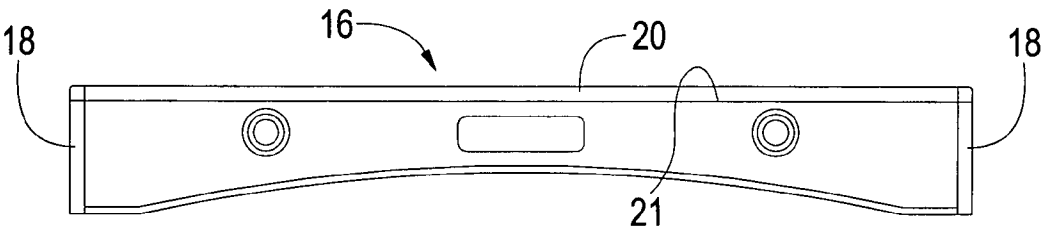
FIG. 3 is an elevation view of a cross member of the present invention.
Figure 4:
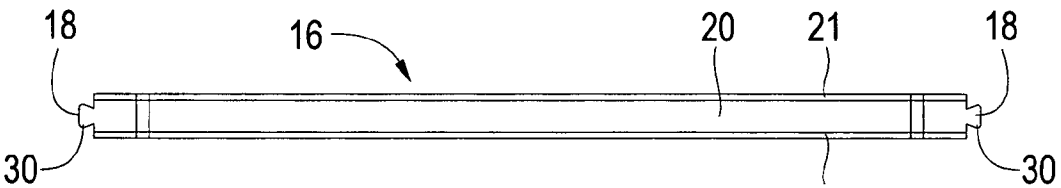
FIG. 4 is a plan view of a cross member of the present invention.
Figure 5:
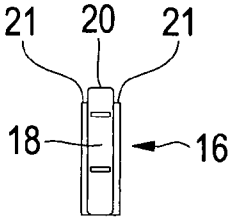
FIG. 5 is an end view of a cross member of the present invention.

With regard to reference numerals used, the following numbering is used throughout the drawings.

| | |
|---|---|
| 10 | present invention |
| 12 | leg |
| 14 | groove |
| 16 | cross member |
| 18 | connecting member |
| 20 | rib |
| 21 | flange |
| 22 | top |
| 23 | edge of top |
| 24 | cutout |
| 25 | underside portion |
| 26 | cup |
| 28 | tray |
| 30 | enlargement |
| 32 | side |
| 33 | edge |
| 34 | shaved corner |
| 36 | enlargement |
| 38 | walls |
| 40 | receptacle |
| 42 | bottom |
| 44 | walls |
| 46 | cup connecting member |
| 48 | enlargement |
| 50 | tray connecting member |
| 52 | table |
| 54 | fort |
| 56 | elongated leg |
| 58 | elongated groove |
| 60 | side panel |
| 62 | user |
| 64 | item |

DETAILED DESCRIPTION OF THE PREFERRED EMBODIMENTS

The following discussion describes in detail at least one embodiment of the present invention. This discussion should not be construed, however, as limiting the present invention to the particular embodiments described herein since practitioners skilled in the art will recognize numerous other embodiments as well. For a definition of the complete scope of the invention the reader is directed to the appended claims. FIGS. 1 through 21 illustrate the present invention wherein a modular furniture construction is disclosed.

Turning to FIG. 1, therein is shown the present invention 10 in an exemplary configuration of a generally rectangular shaped table having a plurality of legs 12 wherein each leg has a plurality of grooves 14 on its upper end for receiving the ends of cross member 16 wherein each cross member has a tongue-like mating or connecting member 18 on each end thereof wherein the mating member can be placed in one of the grooves 14 of the leg which grooves are disposed vertically and spaced circumferentially about 90 degrees apart around the sides of the upper end of each leg parallel to the longitudinal axis of the leg. Each cross member 16 has an upwardly extending rib 20 on its upper edge which is used to connect the top 22 to the cross member 16. The cross members 16 have a tongue-like mating or connecting member 18 on each end. The top 22 has a cutout 24 located on each corner for receiving a mating edge or corner of the upper end of leg 12. Also shown is the cup 26 which can be disposed about the edges of the top 22 along with tray 28 which can be disposed around the edges of the top by having tongue-like mating or connecting members 46, 50 disposed in an unused groove 14 of leg 12. The tray 28 can be used for receiving accessories such as pencils, crayons, erasers and cup 26 can be used for receiving a container having liquid therein.

Figure 20:
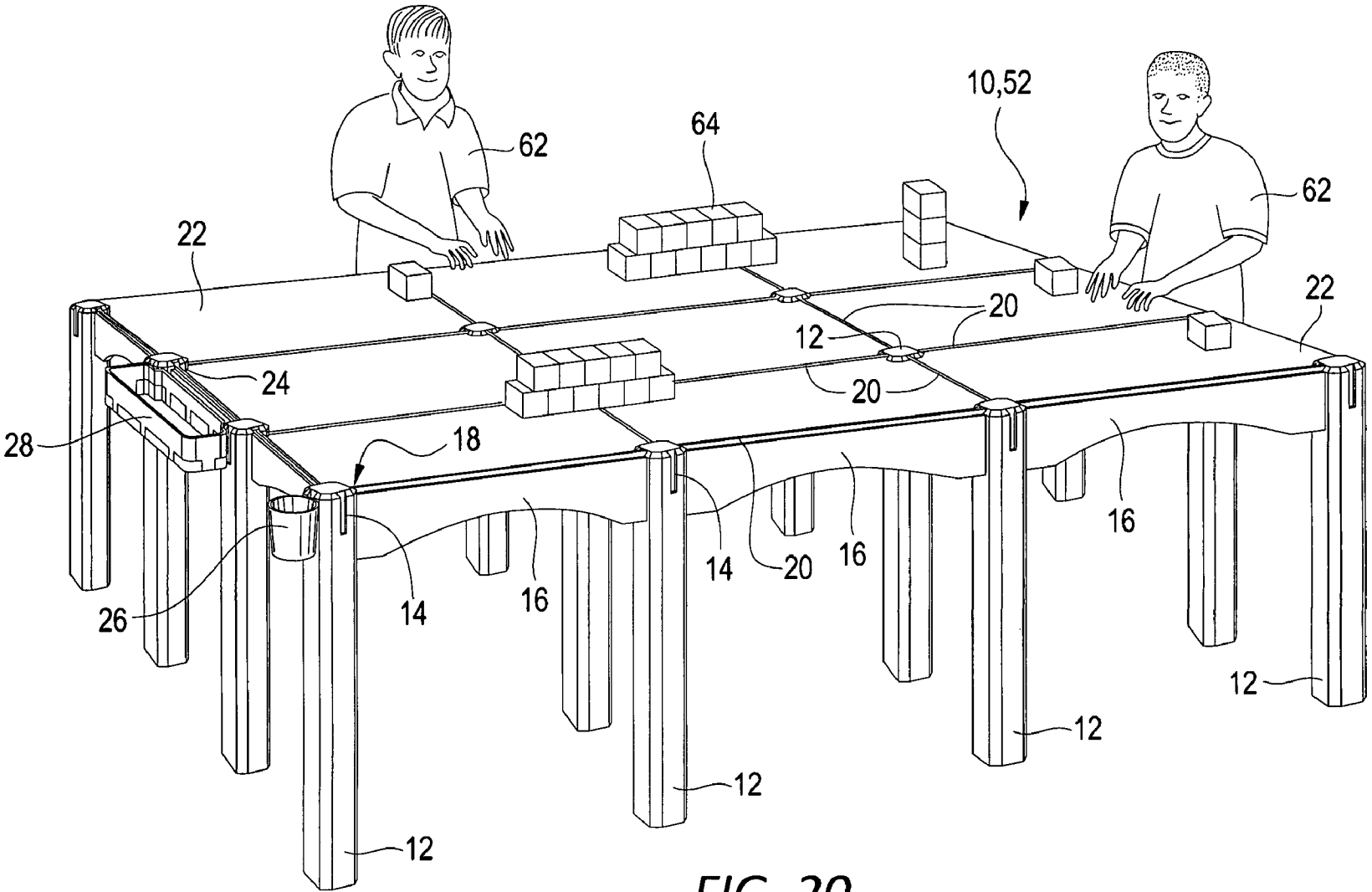
FIG. 20 is a perspective view of a table constructed according to the teachings of the present invention.

Turning to FIGS. 2 through 5, therein are shown various views of cross member 16. Each cross member 16 has a tongue-like mating or connecting member 18 on each end wherein that the tongue-like mating member is effectively enlarged on its end or tip at 30 for secure placement in the mating groove 14 of leg 12 (not shown, see FIG. 8). Also note that the top side of each cross member 16 has an upwardly extending rib member 20 thereon which forms a flange 21 on each side thereof for receiving and securing the mating edge 23 of top 22 (not shown, see FIG. 10). A top 22 can be placed on a flange 21 on each side of the rib 20 so as to form a table having multiple tops as best seen in FIG. 20. Rib 20 is substantially the same height as the edge 23 a top 22 so that the surface of a table having multiple tops would be substantially flat or smooth being ideal for such activities as playing with trains, building toys or the like. It is expected that each cross member 16 will be about forty-eight inches long with the ends beings about four to eight inches in height.

Figure 6:
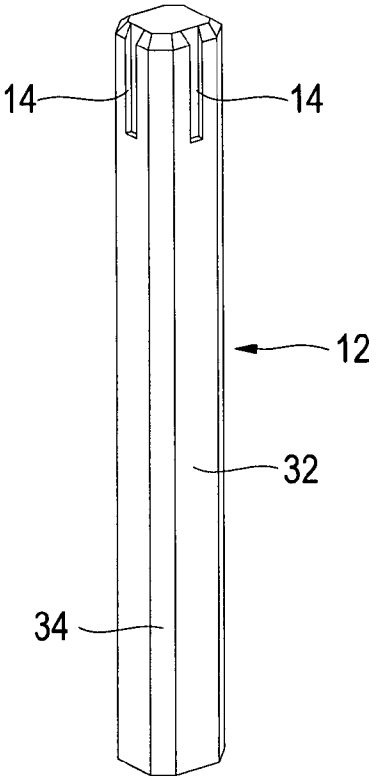
FIG. 6 is a perspective view of a leg of the present invention.
Figure 7:
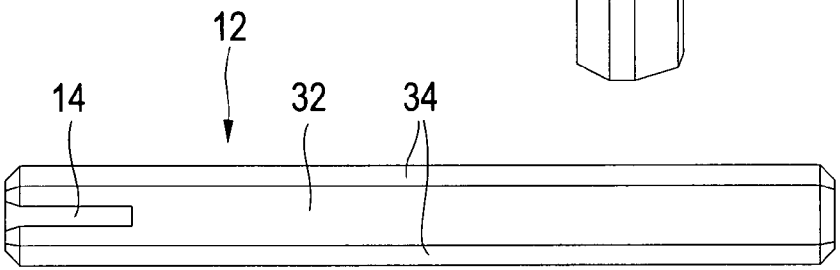
FIG. 7 is an elevation view of a leg of the present invention.
Figure 8:
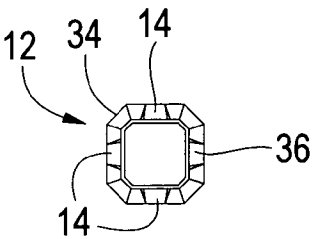
FIG. 8 is an end view of a leg of the present invention.
Figure 12:
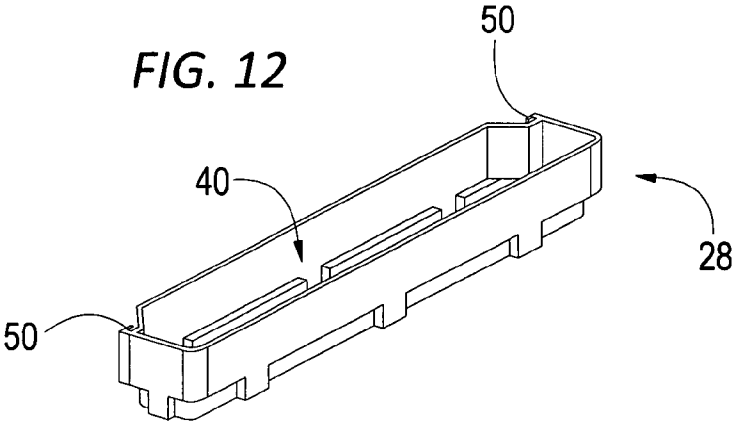
FIG. 12 is a perspective view of a tray of the present invention.
Figure 13:
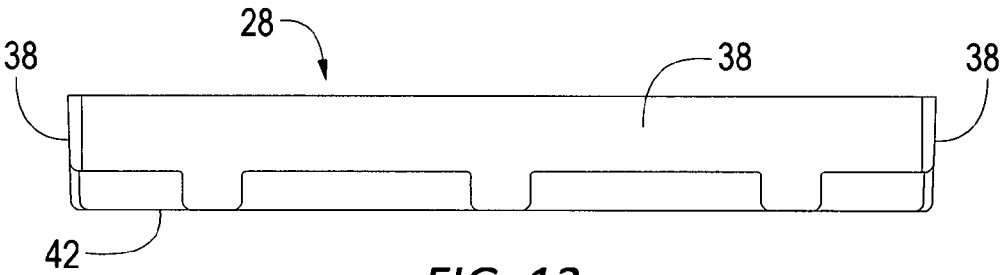
FIG. 13 is an elevation view of a tray of the present invention.
Figure 14:
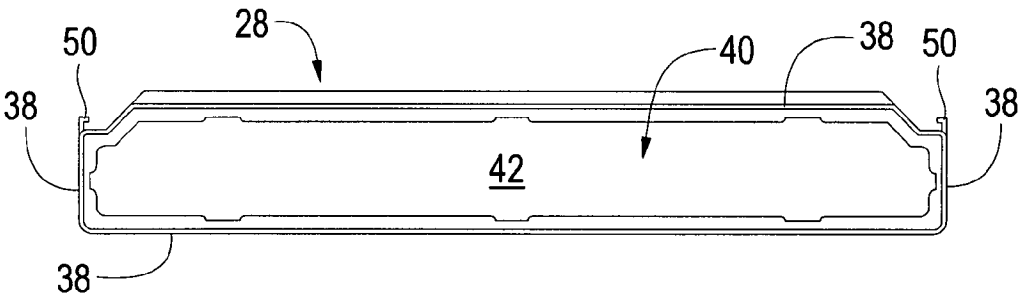
FIG. 14 is a plan view of a tray of the present invention.
Figure 15:
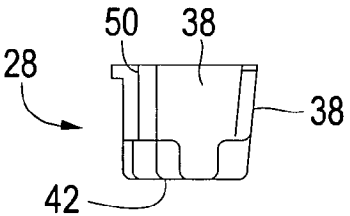
FIG. 15 is an end view of a tray of the present invention.
Figure 17:
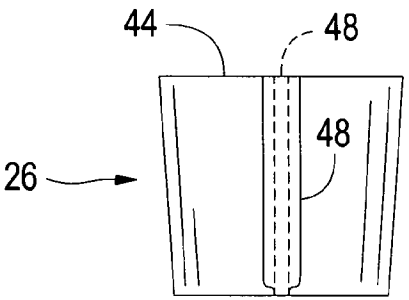
FIG. 17 is an elevation view of a cup of the present invention.
Figure 19:
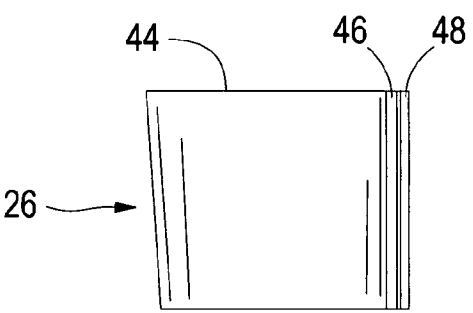
FIG. 19 is an elevation view of a cup of the present invention.
Figure 16:
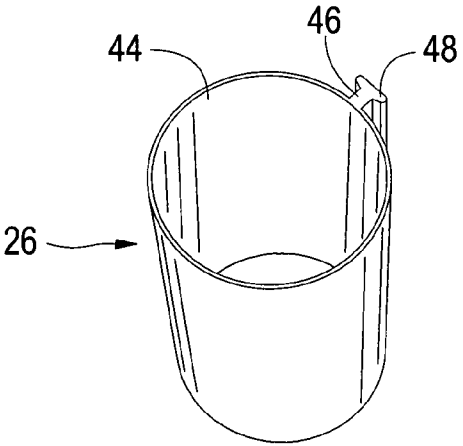
FIG. 16 is a perspective view of a cup of the present invention.
Figure 18:
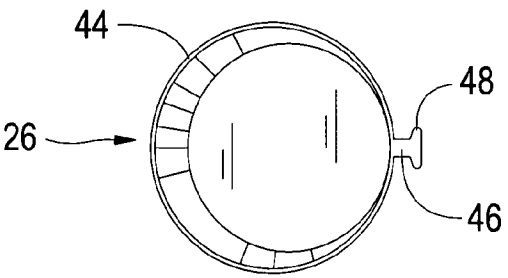
FIG. 18 is a plan view of a cup of the present invention.

Turning to FIGS. 6 through 8, therein is shown leg 12 wherein each leg has a plurality; e.g., four, of sides 32 along with shaved or rounded corners 34 thereon for mating with the top 22 as previously disclosed. Each leg 12 has on its upper end a groove 14 which is centrally disposed on each side 32 wherein each groove has an enlarged receptacle portion 36 disposed toward the central axis of the leg on its upper end for receiving a mating enlargement 30 of a tongue-like or connecting member 18 of each cross member 20 (not shown, see FIGS. 2-5). Note that the enlargement 36 of the leg 12 is complementarily sized and shaped as the enlargement 30 on each cross member 16 and that groove 14 is effectively long, e.g., four-twelve inches, to receive member 18 on the end of cross member 16.

Turning to FIGS. 9 through 11, therein is shown a planar rigid top 22 wherein each top has a cutout 24 on each corner for mating with the shaved corner 34 of each leg 12 (not shown, see FIGS. 6-8). Also shown is edge 23 and a reinforced underside portion 25 of the top 22 which is expected to be about two feet square. Edge 23 rests on flange 21 so as to securely fit the top onto the crossmembers so as to form a table or related structure such as a fort.

Turning to FIGS. 12 through 15, therein is shown the tray 28 being generally rectangular shaped having a plurality of raised walls 38 thereon forming an internal receptacle 40 for placement therein of children's accessories such as pencils, crayons, erasers and the like. Note that the tray 28 has a bottom 42 therein and tongue-like mating or tray connecting member 50 on each end for insertion and connection to the unused grooves 14 of legs 12 (not shown, see FIGS. 6-8).

Turning to FIGS. 16 through 19, therein is shown the cup 26 being generally cylindrically shaped having circular raised walls 44 having a mating tongue-like or cup connecting member 46 thereon having an enlargement on the end thereof 48 for mating with each of the grooves 14 disposed on the upper end of each leg 12 (not shown, see FIGS. 6-8). Cup 26 is for containing liquid, holding items such as crayons, paintbrushes, or the like or receiving a container having liquid therein.

Turning to FIG. 20, therein is shown a large table 52 constructed according to the teachings of the present invention 10. The table 52 is comprised of a plurality of the previously disclosed modular components, e.g., tops 22, legs 12 and crossmembers 16 with ribs 20, having cups 26 and trays 28 attached thereto constructed according to the teachings of the present invention so that a plurality of users 62 can play with items 64, e.g., blocks, disposed on the table tops.

Figure 21:
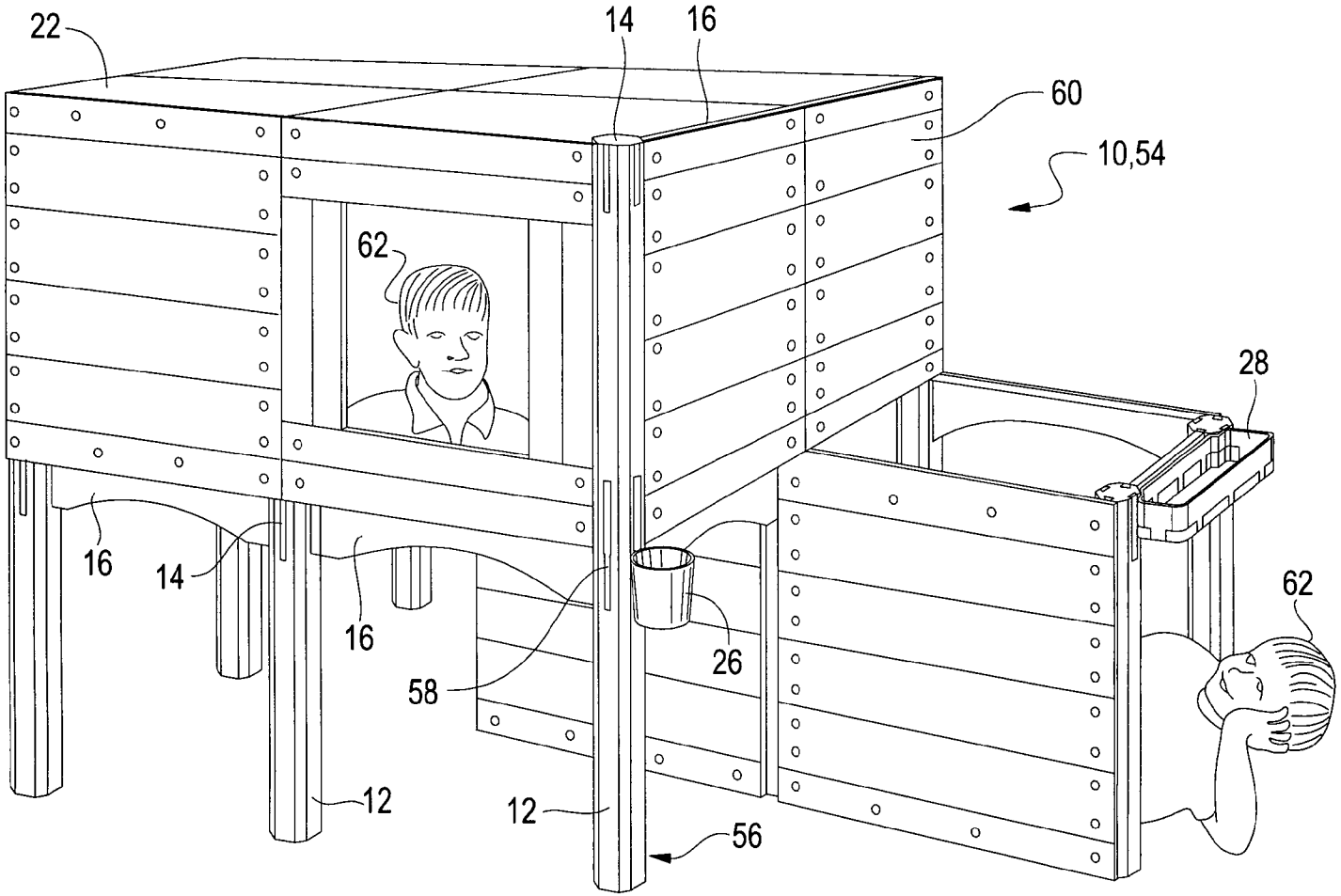
FIG. 21 is a perspective view of a fort constructed according to the teachings of the present invention.

Turning to FIG. 21, therein is shown a fort constructed according to the teachings of the present invention 10. The fort 54 is comprised of a plurality of the previously disclosed modular components constructed according to the teachings of the present invention. Also shown, in addition to legs 12 of regular length as previously disclosed, is an extra long or elongated leg 56 having a first groove 14 at its upper end along with an intermediately disposed elongated second groove 58 which allows for cross members 16 to be connected to the grooves at its middle and its upper end for forming a first and second floor. A plurality of side panels 60 are also attached to the sides of the framework to form sides or walls of the fort 54. Also shown, are a cup 26 and tray 28 attached to the fort constructed so that a plurality of users 62 can play in and about the fort on the first and second floor of the fort.

In operation, the present invention 10 can be arrayed in many configurations wherein the multiple tabletops 22 can be placed on crossmembers 16 which are connected to the legs 12 so as to create numerous configurations of the present invention wherein each of the configurations can have a plurality of trays 28 and a plurality of cups 26 thereon.

I claim:

1. An apparatus for modular furniture, comprising:

a) a planar top being generally rectangular shaped having a plurality of corners and sides thereon, an edge being disposed on each said side, and each said corner having a cutout thereon;

b) a plurality of legs having upper and lower ends, said upper ends having a first set of grooves therein each groove extending only along an upper portion of each leg, each said groove being disposed longitudinally along said leg, each said groove being disposed in a spaced apart relationship circumferentially around said upper end of said leg, each said groove being disposed about ninety degrees apart around said upper end of said leg so as to form a set of grooves, and each said groove having side walls without any flanges; and, c) a plurality of cross members having first and second ends and upper and lower portions, a connecting member being disposed on each said first and second end of said cross member, wherein said connecting member is sized and shaped to be slideably inserted into and removed from said groove for forming a horizontal frame around said leg, wherein each said cross member has an upstanding rib on its upper portion extending substantially from said first to said second end, a flange being formed on either side of said rib, wherein said edge of said side of said top is disposed on said flange on only one side of said rib to a table having four legs, four cross members and a top.

2. The apparatus of claim 1, wherein each said groove of each said leg has a first enlarged portion disposed toward a central axis of said leg.

3. The apparatus of claim 2, wherein each said connecting member has a second enlarged portion disposed on its tip, wherein said first and second enlarged portions are mating portions.

4. The apparatus of claim 1, further comprising a cup, said cup having a cup with a connecting member compatible with said grooves and on said legs so that said cup connecting member can be slidably inserted into and removed from said groove on said leg.

5. The apparatus of claim 1, further comprising a tray, said tray having a connecting member compatible with said grooves and on said legs so that said connecting member can be slidably inserted into and removed from said groove on said leg.

6. The apparatus of claim 1, further comprising an underside portion being disposed on an underside of said top so that said top is reinforced.

7. A method of making modular furniture, comprising the steps of:

a) providing a planar top being generally rectangular shaped having a plurality of corners and sides thereon and having an edge on each side, and each corner having a cutout thereon;

b) providing a plurality of legs having upper and lower ends, the upper ends having a first set of grooves therein extending only along an upper portion of said legs, each groove being disposed longitudinally along the leg, each groove being disposed in a spaced apart relationship circumferentially around the upper end of the leg, each groove being disposed about ninety degrees apart around the upper end of the leg so as to form a set of grooves, each said groove having side walls without any flanges;

c) providing a plurality of cross members having first and second ends and upper and lower portions, a connecting member being disposed on each first and second end of the cross member, wherein the connecting member is sized and shaped to be slideably inserted into and removed from the groove for forming a horizontal frame around the leg, wherein each cross member has an upstanding rib on its upper portion extending substantially from the first to the second end, a flange being formed on either side of the rib, wherein the edge of the side of the top is disposed on the flange on only one side of said rib; and, d) forming a table having a top, four legs and four cross members.

8. The method of claim 7, wherein the legs are elongated so as to form an extra long leg, a second set of grooves being disposed intermediate the upper and lower ends for forming furniture having an additional floor.

9. The method of claim 7, wherein each groove of each leg has a first enlarged portion disposed toward the central axis of said leg.

10. The method of claim 7, wherein each connecting member has a second enlarged portion disposed on its tip, wherein the first and second enlarged portions are mating portions.

11. The method of claim 7, further comprising the step of providing a cup, the cup having a connecting member compatible with said grooves on said legs disposed thereon so that the connecting member can be slidably inserted into and removed from a groove on the leg.

12. The method of claim 7, further comprising the step of providing a tray, the tray having at least one connecting member compatible with said grooves on said legs so that the connecting member can be slidably inserted into and removed from the groove on the leg.

13. The method of claim 7, further comprising the step of providing an underside portion being disposed on an underside of the top so that the top is reinforced.

14. The method of claim 7, forming a table having a plurality of tops by connecting a plurality of tops to a plurality of cross members and a plurality of legs each adjoining tops resting on a flange on opposite sides of a rib.

15. The method of claim 14, wherein the table has substantially a flat surface.

16. A method of making a fort from modular furniture elements, comprising the steps of:

a) providing a planar top being generally rectangular shaped having a plurality of corners and sides thereon and having an edge on each side, and each corner having a cutout thereon;

b) providing a plurality of legs having upper and lower ends, the upper ends having a first set of grooves therein, each groove being disposed longitudinally along the leg, each groove being disposed in a spaced apart relationship circumferentially around the upper end of the leg, each groove being disposed about ninety degrees apart around the upper end of the leg so as to form a set of grooves, and a second set of grooves being spaced from said first set of grooves between bottoms and tops of said legs corresponding to said first set of grooves;

c) providing a plurality of cross members having first and second ends and upper and lower portions, a connecting member being disposed on each first and second end of the cross member, wherein the connecting member is sized and shaped to be slideably inserted into and removed from the groove for forming a horizontal flame around the leg, wherein each cross member has an upstanding rib on its upper portion extending substantially from the first to the second end, a flange being formed on either side of the rib, wherein the edge of the side of the top is disposed on the flange;

d) connecting a plurality of tops to a plurality of cross members engaged with said second set of slots on said legs so as to form a first floor of said fort; and e) connecting another plurality of tops to said cross members adjacent top ends of said legs to enclose said second floor, wherein the fort has a first and a second floor.

17. The method of claim 16, further providing the step of providing at least one side panel on the fort.

* * * * *